US006560419B2

(12) United States Patent
Sugiura

(10) Patent No.: US 6,560,419 B2
(45) Date of Patent: May 6, 2003

(54) CHARGING DEVICE FOR APPLYING AC VOLTAGE OF A FREQUENCY TO CHARGED BODY AND IMAGE FORMING APPARATUS INCLUDING SUCH A DEVICE

(75) Inventor: Kenji Sugiura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/865,521

(22) Filed: May 29, 2001

(65) Prior Publication Data

US 2002/0001478 A1 Jan. 3, 2002

(30) Foreign Application Priority Data

May 30, 2000 (JP) ..... 2000-159465
May 7, 2001 (JP) ..... 2001-136653

(51) Int. Cl.[7] ..... G03G 15/02

(52) U.S. Cl. ..... 399/50; 361/221; 361/225; 399/168

(58) Field of Search ..... 399/168, 176, 399/174, 175, 50; 361/225, 221, 222, 223, 212, 230, 235, 220

(56) References Cited

U.S. PATENT DOCUMENTS 5,089,851 A * 2/1992 Tanaka et al. ..... 399/176
5,126,913 A * 6/1992 Araya et al. ..... 399/168
5,146,280 A * 9/1992 Kisu ..... 361/225
5,426,488 A * 6/1995 Hayakawa et al. ..... 399/174
5,483,324 A * 1/1996 Otsuka ..... 399/175
5,485,252 A * 1/1996 Ishida et al. ..... 399/168
5,512,982 A * 4/1996 Takahashi et al. ..... 361/225
5,576,808 A * 11/1996 Ikegawa et al. ..... 399/175
5,619,311 A * 4/1997 Kurokawa et al. ..... 399/176
5,713,067 A * 1/1998 Mizoe et al. ..... 399/176
5,715,499 A * 2/1998 Yamazaki et al. ..... 361/220
5,870,657 A * 2/1999 Nagame et al. ..... 361/225

FOREIGN PATENT DOCUMENTS

| | | | |
|---|---|---|---|
| JP | 63-007380 | | 1/1988 |
| JP | 63-149668 | | 6/1988 |
| JP | 64-024264 | | 1/1989 |
| JP | 01-093760 | | 4/1989 |
| JP | 5/150564 | * | 6/1993 |
| JP | 8-202124 | | 8/1996 |
| JP | 10-186807 | | 7/1998 |

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

In the charging device, a frequency f(Hz) is set so that a frequency f(Hz) of an AC voltage to be applied to a charging member and a movement rate v(mm/sec) of the surface of an image carrier satisfy f(Hz)≧40(1/mm)·v(mm/sec), the charging device positioned in a non-contact state with the surface of the image carrier.

14 Claims, 8 Drawing Sheets

CHARGING DEVICE FOR APPLYING AC VOLTAGE OF A FREQUENCY TO CHARGED BODY AND IMAGE FORMING APPARATUS INCLUDING SUCH A DEVICE

FIELD OF THE INVENTION

The present invention relates to a charging device having a charging member which is disposed opposite to the surface of a movable charged body, and charges the charged body by applying a voltage obtained by superposing an AC voltage on a DC voltage to the charging member to generate electric discharge between the charging member and the surface of the charged body. This invention also relates to an image formation apparatus having the charging device.

BACKGROUND OF THE INVENTION

The above-mentioned type of charging device has conventionally been used widely in various types of machine and device. For example, the charging device is applied in an image forming device formed as a digital copier, a printer, a facsimile, or a multifunction machine provided with at least two of these functions. In order to form an electrostatic latent image on a charged body composed of an image carrier, this charging device charges the image carrier.

When such a charging device applies charge to the charged body, it is important that the surface of the charged body is uniformly charged without charge unevenness occurring on the surface of the charged body, that is, it is important to increase charge uniformity on the surface of the charged body. This will be explained by referring to the charging device used in the image forming device. The image carrier charged by the charging device is exposed to form an electrostatic latent image on the image carrier, and this electrostatic latent image is visualized as a toner image by a developing device. However, if there is charge unevenness on the surface of the charged body when the image carrier is charged by the charging device, density unevenness occurs on the developed toner image, so that the quality of the obtained image is degraded.

Conventionally, various types of configuration have been proposed in order to solve these problems. One of the configurations is a known charging device in which a peak-to-peak voltage of an AC voltage to be applied to a charging member is set to a value which is twice or more a charge start voltage (Japanese Patent Application Laid-Open No. 63-149669). The charge start voltage mentioned here is an absolute value of such a voltage at the instant when a charged body starts to be charged through application of only a DC voltage to the charging member and gradual increase of the absolute value of the applied voltage.

This type of charging device can more effectively enhance the charge uniformity of the charged body as compared to charging devices according to another proposals. However, the inventors have found, after careful studies on the charging device according to this proposal, that the material of the charging member capable of uniformly charging the charged body is limited. For example, when the entire charging member made of metal is used, it is difficult to control a discharge current producing between the charging member and the charged body so as to uniformly charge the charged body, even if the voltage to be apply to this charging member is set to the value. Thus, it is impossible to sufficiently increase charge uniformity of the charged body.

Further, some of the conventional charging devices has the charging member whose electric resistance varies depending on environmental variations. Thereby the charge uniformity of the charged body is largely lowered.

SUMMARY OF THE INVENTION

It is object of this invention to provide a charging device that can keep charge uniformity of a charged body at a high level without being largely affected by a material of a charging member and even if its environment changes. Another object of this invention is to provide an image formation apparatus having such a charging device.

In order to achieve the former object of this invention, the charging device according to this invention is proposed as follows. That is, in the above-mentioned type of charging device, a frequency f(Hz) is set so as to satisfy $f(Hz) \geqq 40 (1/mm) \cdot v(mm/sec)$ where the frequency of an AC voltage is f(Hz) and a movement rate of the surface of a charged body is v(mm/sec).

Further, it is advantageous that a peak-to-peak voltage of an AC voltage to be applied to the charging member is set to a voltage which is twice or more a charge start voltage of the charged body.

Further, in the charging device according to this invention, it is advantageous that the charging member is positioned in a non-contact state with respect to the surface of the charged body while charging the charged body.

Further, in the charging device according to this invention, it is advantageous that the charging member is formed with a material having JIS A hardness of 90 degrees or more.

Further, in the charging device according to this invention, it is advantageous that the charging member is made of metal.

Further, in the charging device according to this invention, it is advantageous that the charging member is positioned in contact with the surface of the charged body while charging the charged body.

Further, in the charging device according to this invention, it is advantageous that the charging member has an elastic body.

Further, in the charging device according to this invention, it is advantageous that the charging member comprises a base substance to which the voltage is applied, and an intermediate resistor which is provided on the side of the base substance facing the surface of the charged body and has a volume resistivity higher than that of the base substance.

Further, in the charging device according to this invention, it is advantageous that the charging member is cylindrically formed.

Further, in the charging device according to this invention, it is advantageous that the charging member is formed as a charge roller that rotates.

In order to achieve the latter object of this invention, an image formation apparatus as follows is proposed. This image formation apparatus has the charging device according to this invention, and a charged body is composed of an image carrier with a toner image formed on its surface.

Other objects and features of this invention will become understood from the following description with reference to the accompanying drawings.

DESCRIPTION OF THE PREFERRED EMBODIMENT

A preferred embodiment of this invention will be explained below in detail with reference to the drawings.

Figure 1:
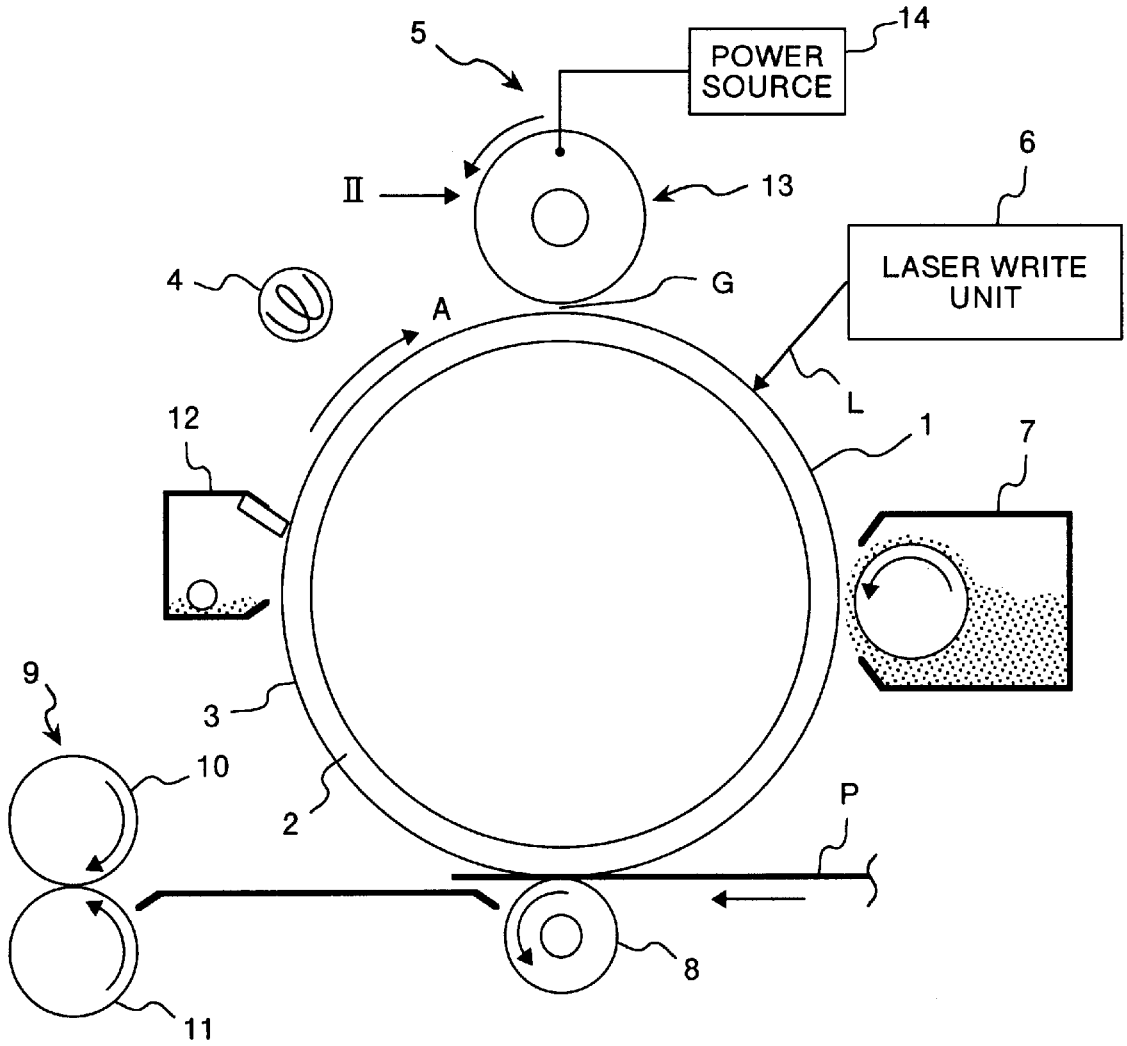
FIG. 1 is a partial cross-sectional view schematically showing the image formation apparatus.

The schematic diagram in FIG. 1 shows the image formation apparatus having the charging device as an example. The image formation apparatus shown here is formed as a copier, a printer, a facsimile, or a multifunction machine provided with at least two of these functions. An image carrier 1 as an example of a charged body is disposed in the housing of the main body, which is not shown. This image carrier is composed of a photoreceptor with a photosensitive layer 3 laminated around the peripheral surface of a conductive base 2 on its drum. An image carrier composed of a belt-like photoreceptor that is wound around a plurality of rollers to be driven, or a drum-like or a belt-like image carrier composed of a dielectric body can be used.

At the time of forming an image, the image carrier 1 is rotated in the clockwise direction in FIG. 1, and its surface moves in the direction indicated by the arrow A. At this time, the surface of the image carrier is irradiated with the light from a discharge lamp 4. The surface is initialized and charged to a predetermined polarity by the charging device 5. The charging device 5 will be explained in detail later.

The surface of the image carrier charged by the charging device 5 is irradiated with a laser beam L that is emitted from a laser write unit 6 as an example of an exposing device and is subjected to light modulation. With this irradiation, an electrostatic latent image is formed on the surface of the image carrier. This electrostatic latent image is then visualized as a toner image by toner charged to a predetermined polarity when passing through a developing device 7.

On the other hand, a transfer material P such as a transfer paper is fed at a predetermined timing into between the image carrier 1 and a transfer device 8 disposed opposite to the image carrier 1. At this time, the toner image formed on the image carrier is electrostatically transferred onto the transfer material P. The transfer material P with the toner image transferred then passes through between a fixing roller 10 of a fixing device 9 and a pressure roller 11. During this passage, the toner image is fixed onto the transfer material by the action of heat and pressure. The residual toner after transfer remaining on the surface of the image carrier without being transferred to the transfer material is removed by a cleaning device 12.

The charging device 5 comprises a charging member 13 disposed opposite to the surface of the movable charged body, that is, the surface of the image carrier 1 in the shown example, and a power source 14 that applies a voltage to the charging member 13. A voltage is applied to the charging member 13 by this power source 14 to produce electric discharge between the charging member 13 and the surface of the image carrier, and the surface of the image carrier is charged to a predetermined polarity.

The charging member can be structured in any of various types as explained later. The charging member 13 as shown in FIG. 1 is cylindrically formed, and the overall member is made of metal such as stainless steel. When charging the charged body, the charging member may be positioned in a non-contact state with respect to the surface of the charged body, or may be positioned in contact with its surface. The charging member 13 shown in FIG. 1 is disposed opposite to the surface of the image carrier spaced by a fine gap G of 10 $\mu$m to 150 $\mu$m between the two.

Figure 2:
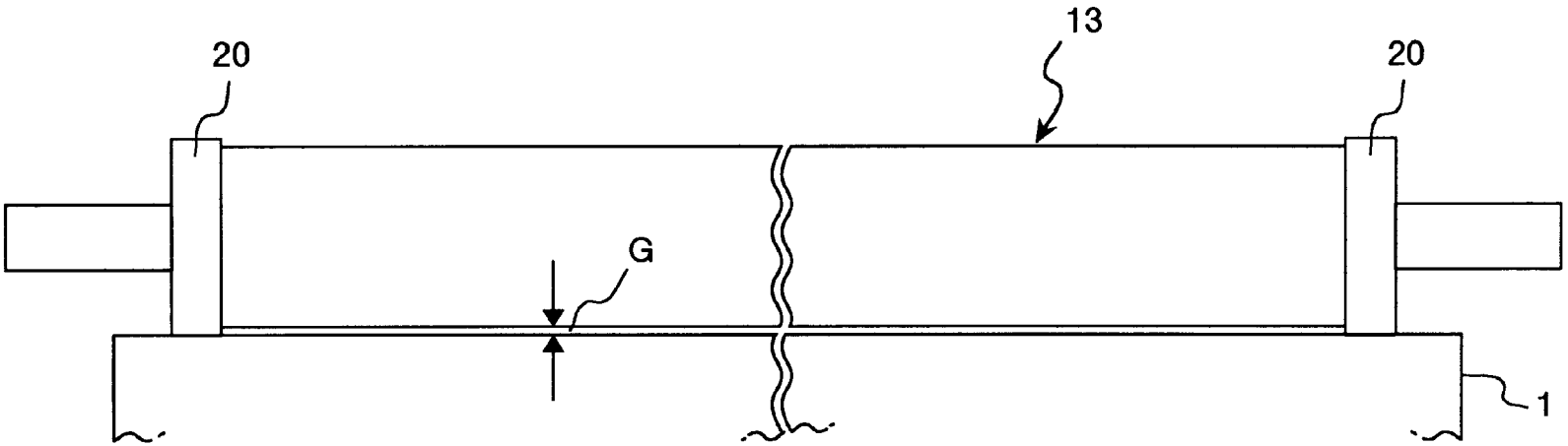
FIG. 2 is a diagram of the image formation apparatus when viewed from the direction of the arrow II in FIG. 1.

FIG. 2 shows a structure as an example of disposing the charging member 13 opposite to the surface of the image carrier spaced by the fine gap G between the two. The charging member 13 shown here has spacers as tapes 20 adhered to both of its end areas in its longitudinal direction. These tapes 20 are brought into contact with the surface of the image carrier to keep the fine gap G of the charging member 13 with respect to the surface of the image carrier.

A voltage obtained by superposing an AC voltage on a DC voltage is applied to the charging members 13 shown in FIG. 1 and FIG. 2, and the surface of the image carrier is charged to the same potential as the applied DC voltage. The superposed voltage of the DC voltage and the AC voltage is applied to the charging member to produce electric discharge between the charging member and the surface of the charged body, and charge is applied to the charged body. As explained above, by applying not only the DC voltage but also the AC voltage, the charge uniformity on the surface of the image carrier can be increased. However, the increase in the charge uniformity is limited only with this structure.

To solve the problem, in the charging device 5 of this embodiment, a frequency f(Hz) is set so as to satisfy $f(Hz) \geqq 40(1/mm) \cdot v(mm/sec)$ where the frequency of the AC voltage to be applied to the charging member 13 is f(Hz) and the movement rate of the surface of the charged body, that is, the surface of the image carrier in this embodiment, is v(mm/sec). By setting the frequency f(Hz) to such a value, it is possible to effectively reduce charge unevenness on the surface of the image carrier, further increase charge uniformity on its surface, eliminate density unevenness of the toner image, and enhance the image quality. The reason that these effects can be obtained will be explained later.

In the charging device 5 of this embodiment, a peak-to-peak voltage Vpp of the AC voltage to be applied to the charging member 13 is set to a value that is twice or more the charge start voltage of the charged body, which is well known. With this value, charge uniformity on the surface of the image carrier can more reliably be increased. As already mentioned above and also explained in detail in Japanese Patent Application Laid-Open No. 63-149669, the charge start voltage of the charged body is an absolute value of such a voltage at the instant when the charged body starts to be charged through application of only the DC voltage to the charging member 13 and gradual increase of the absolute value of the applied voltage.

Referring to the structure more specifically, as shown in FIG. 1 and FIG. 2, it is supposed that the charging member 13 is disposed in a non-contact state, that is, spaced by the fine gap G from the surface of the image carrier 1. When the gap G is 100 $\mu$m and the movement rate v (mm/sec) of the surface of the image carrier 1 is 200 mm/sec, the peak-to-peak voltage Vpp of the AC voltage to be applied to the charging member 13 is set to 3 KV, for example, and the frequency f(Hz) of the AC voltage is set to 8 KHz. Further, the DC voltage Vd(V) to be applied to the charging member 13 is set to −800 V. Based on these settings, the surface of the image carrier can be uniformly charged to −800 V.

As explained above, when the entire charging member 13 is made of metal, the surface of the image carrier can also be charged uniformly. When charge unevenness occurs on the surface of the image carrier, spot-like or linear-shaped density unevenness appears on an image particularly when a developed toner image is a half-tone image, which causes the image quality to be degraded. However, by employing the structure of this embodiment, it is possible to effectively suppress occurrence of such density unevenness.

The charging member may be structured in any type other than the types shown in FIG. 1 and FIG. 2, and the structure can be applied for any of the charging members. A typical and specific example of the charging member will be explained below.

Figure 3:
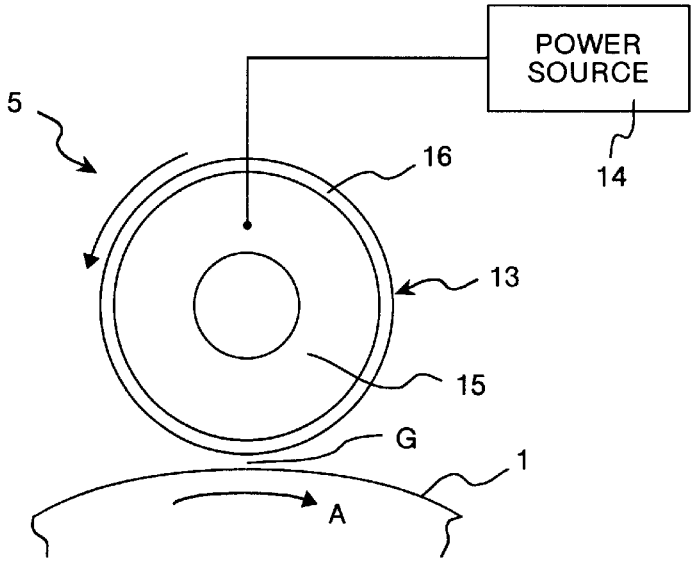
FIG. 3 is a schematic diagram showing the charging member as another example.

The charging member 13 shown in FIG. 3 comprises a base substance 15 made of a rigid body such as metal, and a hard resistance layer 16 laminated around the peripheral surface of the base substance, and the whole of the member is cylindrically formed. This charging member 13 is also disposed spaced by a fine gap G with respect to the surface of the image carrier 1.

Figure 4:
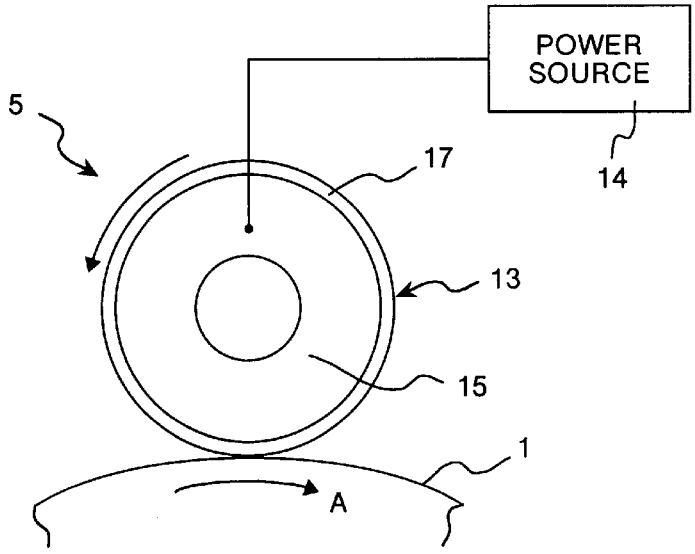
FIG. 4 is a schematic diagram showing the charging member as still another example.

The charging member 13 shown in FIG. 4 comprises a cylindrical base substance 15 made of a rigid body such as metal, and an elastic layer 17 made of rubber laminated around its peripheral surface, and the whole of the member is cylindrically formed. This elastic layer 17 is composed of an intermediate resistor as explained later.

Figure 5:
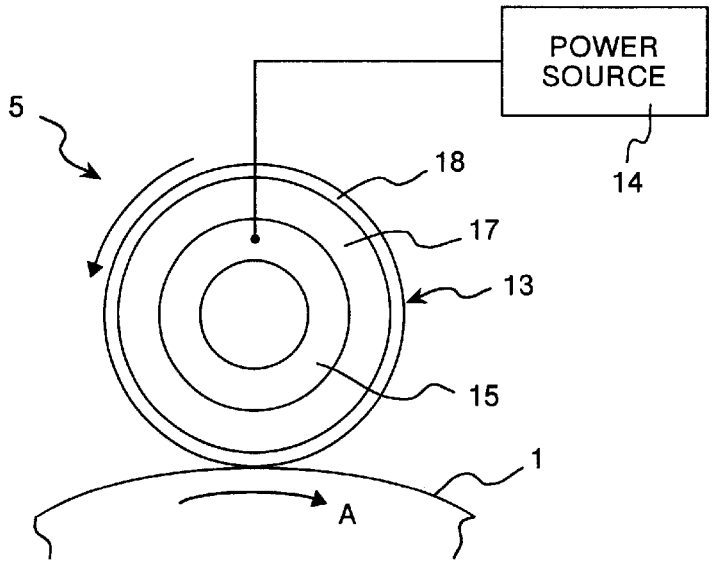
FIG. 5 is a schematic diagram showing the charging member as a further example.

The charging member 13 shown in FIG. 5 is cylindrically formed with a protective layer 18 further laminated around the peripheral surface of the elastic layer 17 of the charging member shown in FIG. 4.

Figure 6:
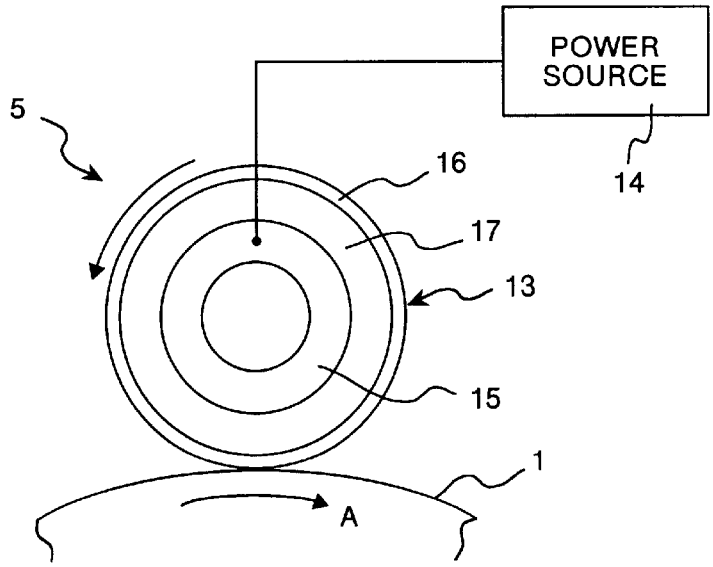
FIG. 6 is a schematic diagram showing the charging member as a still further example.

Further, the charging member 13 shown in FIG. 6 is formed with a cylindrical body having the cylindrical base substance 15 made of a rigid body such as metal, an elastic layer 17 laminated around the peripheral surface of the base material 15, and a resistance layer 16 further laminated around the peripheral surface of the elastic layer 17. The elastic layer 17 shown in FIG. 6 is formed with a conductor.

Figure 7:
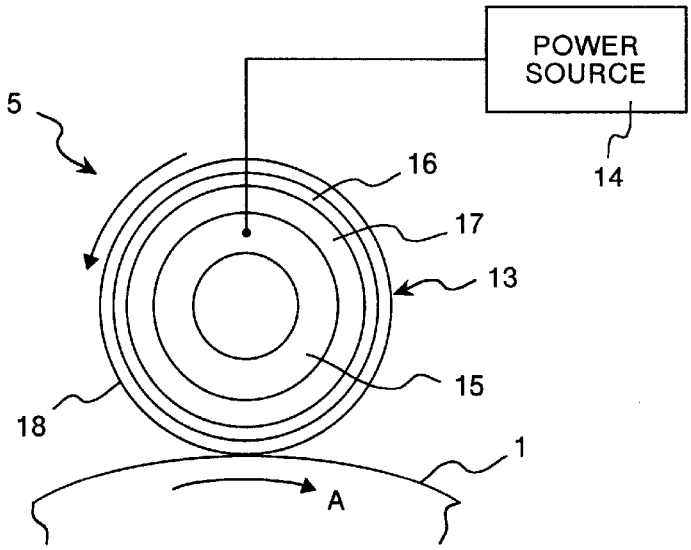
FIG. 7 is a schematic diagram showing the charging member as a still further example.

Further, the charging member 13 shown in FIG. 7 is formed with a cylindrical body obtained by further laminating the protective layer 18 around the peripheral surface of the resistance layer 16 of the charging member shown in FIG. 6.

Each of the charging members 13 shown in FIG. 4 to FIG. 7 is in contact with the surface of the image carrier 1 at the time of charging the image carrier 1.

Figure 8:
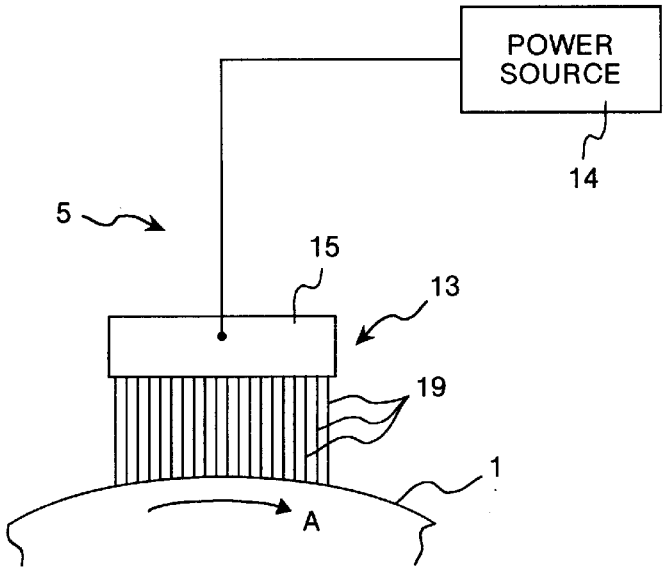
FIG. 8 is a schematic diagram showing the charging member as a still further example.

Further, the charging member 13 shown in FIG. 8 is composed of a rectangular base substance 15 made of a rigid body such as metal, and a plurality of brush fibers 19 whose base part is fixed to the base substance 15.

Figure 9:
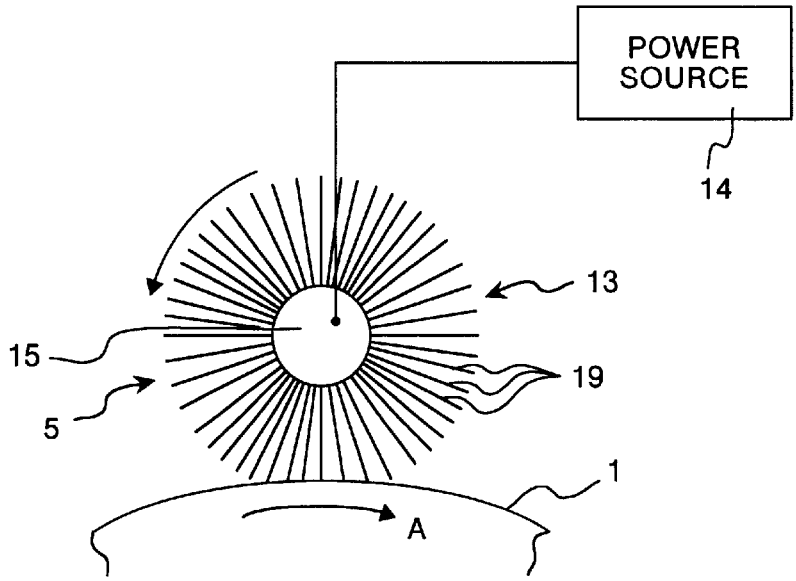
FIG. 9 is a schematic diagram showing the charging member as a still further example.

Further, the charging member 13 shown in FIG. 9 is composed of a cylindrical base substance 15 made of a rigid body such as metal, and a plurality of brush fibers 19 whose base part is fixed to the peripheral surface of the base substance 15. Each portion of the brush fibers 19 of the charging members 13 shown in FIG. 8 and FIG. 9 is in contact with the surface of the image carrier at its free end side.

Figure 10:
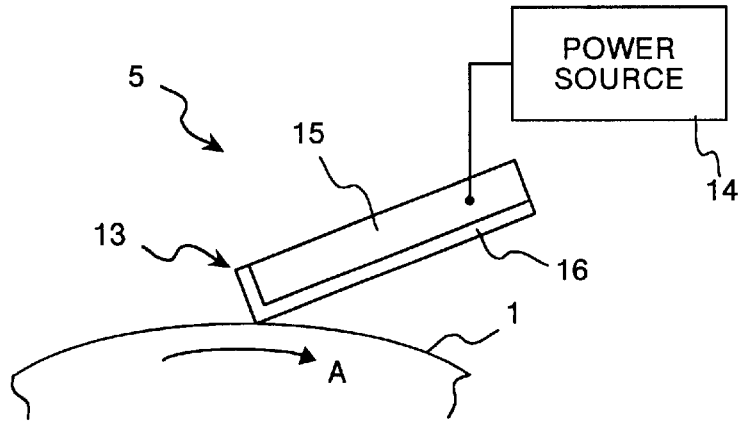
FIG. 10 is a schematic diagram showing the charging member as a still further example.

The charging member 13 shown in FIG. 10 is composed of a base substance 15 made of an elastic body, and a resistance layer 16 laminated on the surface of the base substance 15 facing the image carrier 1. The entire member has the form of a blade. The charging member 13 shown here has the resistance layer 16 that is in contact with the surface of the image carrier 1.

Figure 11:
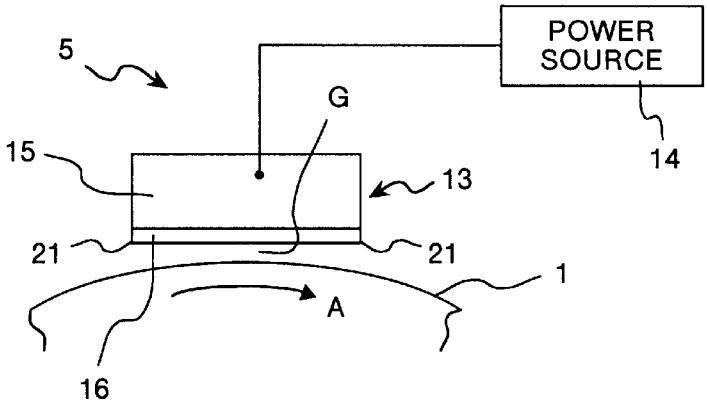
FIG. 11 is a schematic diagram showing the charging member as a still further example.

Further, the charging member 13 shown in FIG. 11 is composed of a base substance 15 made of a rigid body such as metal, and a hard resistance layer 16 laminated on the surface of the base substance 15 facing the image carrier 1, and the entire member has the form of a rectangle. This charging member 13 is disposed spaced by a fine gap G with respect to the surface of the image carrier 1.

Each of the base substances 15 of the charging members 13 shown in FIG. 3 to FIG. 11 has a volume resistivity that is set to a value of $1\times10^3$ ohm-cm or less, particularly to a value of $1\times10^2$ ohm-cm or less. The power source 14 is connected to such a base substance 15 to apply the voltage to each of the charging members 13. The entire charging member 13 shown in FIG. 1 is formed with metal, that is, a conductor, and such a charging member itself is applied with the voltage through a connection with the power source 14.

The image carrier can uniformly be charged by applying the above-mentioned voltage to any of the charging members. As explained above, the image carrier can uniformly be charged without restriction to the type of charging member or its material as in the conventional case.

The conventional charging device applies simply a voltage obtained by superposing the AC voltage on the DC voltage to the charging member having the resistance layer and the elastic layer. In this case, respective electric resistances of the resistance layer and the elastic layer change according to their environmental variations. Therefore, it has been difficult to uniformly charge the image carrier when the environment is changed. However, by utilizing the voltage application method according to this embodiment, it is also possible to uniformly charge the image carrier even if the environment changes even if the charging member has the resistance layer and the elastic layer.

As explained above, when charging the charged body, the charging member may be positioned in a non-contact state with respect to the surface of the charged body, or may be positioned in contact with its surface. However, when the charging member is made of a rigid body, the charging member is disposed preferably in a non-contact state with respect to the charged body, as explained below.

Each of the charging members 13 shown in FIG. 1 to FIG. 3 and FIG. 11 is made of a rigid body, and formed with the material having JIS A hardness of 90 degrees or more. The entire charging member 13 shown particularly in FIG. 1 is made of metal and has a high degree of rigidity. When the charging member 13 formed with the rigid body is brought into contact with the surface of the image carrier, the charging member 13 repeats movements such that the charging member 13 vibrates through rotation of the image carrier, slightly jumps from the surface of the image carrier, and drops again onto the surface of the image carrier.

Therefore, the charging member 13 can not keep in close contact with the surface of the image carrier. Thereby, charge uniformity of the image carrier may lower. Accordingly, when the charging member 13 is made of the rigid body, as shown in FIG. 1 to FIG. 3 and FIG. 11, it is preferable that the charging member 13 is disposed in a non-contact state, that is, spaced by a fine gap from the surface of the image carrier.

At this time, by forming the charging member 13 with the rigid body and forming the entire charging member 13 with metal as the example shown particularly in FIG. 1, straightness in the longitudinal direction of the charging member 13 can be enhanced. Accordingly, the gap G between the charging member 13 and the surface of the image carrier can be kept at a constant level with high precision in the longitudinal direction of the charging member 13. Thus, the function to uniformly charge the surface of the image carrier can be further enhanced. When the charging member 13 is in contact with the surface of the image carrier, toner or the like may be adhered to the surface of the charging member to soil the surface of the member or to scratch the charging member and the surface of the image carrier. Such dirt or scratches may cause occurrence of abnormal discharge. However, by disposing the charging member 13 apart from the surface of the image carrier, such inconvenience does not also occur.

In contrast, each of the charging members 13 shown in FIG. 4 to FIG. 7 is in contact with the surface of the image carrier while charging the image carrier. When the charging member 13 is brought into contact with the surface of the image carrier, as explained above, the charging member 13 has preferably the elastic layer 17 made of rubber, for example. Accordingly, the charging member 13 can be in tight contact with the surface of the image carrier at uniform pressure, which can reliably reduce occurrence of charge unevenness on the surface of the image carrier. Each of the charging members 13 shown in FIG. 8 and FIG. 9 has the elastic brush fibers 19, and the base substance 15 of the charging member 13 shown in FIG. 10 also has elasticity. Therefore, these charging members 13 are also appropriate to be in contact with the surface of the image carrier. As explained above, when the charging member is brought into contact with the surface of the charged body, it is preferable that the charging member has an elastic body formed with an elastic layer, elastic brush fibers, or an elastic base substance, or the like.

The purpose of the protective layer 18 provided at the outermost part of the charging members 13 shown in FIG. 5 and FIG. 7 is to prevent degradation of the image carrier from its promotion. This degradation is caused by the elastic layer 17 made of an elastic member such as rubber or the resistance layer 16, which is in direct contact with the surface of the image carrier.

Each of the charging members 13 shown in FIG. 1 to FIG. 3 and FIG. 11 does not require the elastic layer because it does not contact the surface of the image carrier. Such a charging member with no elastic layer is not necessarily required to have a multilayer structure like the charging members 13 shown in FIG. 6 and FIG. 7, thereby simplifying the structure of the charging member and reducing the cost.

Each of the charging members 13 shown in FIG. 3, FIG. 6, FIG. 7, FIG. 10, and FIG. 11 has the resistance layer 16, while each of the charging members 13 shown in FIG. 4 and FIG. 5 has the elastic layer 17. Further, each of the charging members 13 shown in FIG. 8 and FIG. 9 has the brush fibers 19. Each of these resistance layers 16, elastic layers 17 shown in FIG. 4 and FIG. 5, and brush fibers 19 shown in FIG. 8 and FIG. 9 is formed with the intermediate resistor, whose volume resistivity is set to a value of $1\times10^4$ to $1\times10^{10}$ ohm-cm. The volume resistivity of these intermediate resistors is the value higher than the volume resistivity of the base substance 15 connected to the power source 14. As explained above, each of these charging members has the base substance 15 to which the voltage is applied and the intermediate resistor provided on the side of the base substance 15 facing the surface of the charged body. The intermediate resistor has the volume resistivity higher than that of the base substance. By providing such an intermediate resistor, the following effects can be achieved.

When there is a defect such as a pinhole on a photosensitive layer 3 of the image carrier 1, a discharge current concentrates on the pinhole to produce abnormal discharge, so that the surface of the image carrier may not be uniformly charged. Further, when abnormal discharge occurs, an over current further enlarges the pinhole, which may cause the photosensitive layer 3 to be broken. In order to prevent such inconvenience, the intermediate resistor formed with the resistance layer 16 having the volume resistivity, the elastic layer 17, or the brush fibers 19 is provided on each of the charging members 13 shown in FIG. 3 to FIG. 11. By providing such an intermediate resistor, occurrence of abnormal discharge can be prevented and the inconvenience can be inhibited even if the pinhole exists on the photosensitive layer 3 of the image carrier 1.

The intermediate resistor has the volume resistivity of $1\times10^4$ ohm-cm to $1\times10^{10}$ ohm-cm, as explained above. If the volume resistivity is lower than $1\times10^4$ ohm-cm, concentration of the current can not be prevented when the pinhole is present on the photosensitive layer 3, so that abnormal discharge may occur. Conversely, if the volume resistivity of the resistor exceeds $1\times10^{10}$ ohm-cm, the voltage at the resistor largely drops, which may not produce electric discharge for charging.

The thickness of the intermediate resistor such as the resistance layer 16 of each of the charging members shown in FIG. 3, FIG. 6, FIG. 7, FIG. 10, and FIG. 11 and of the intermediate resistor such as the elastic layer 17 of each of the charging members shown in FIG. 4 and FIG. 5 are preferably 100 to 3000 $\mu$m. If the thickness is less than 100 $\mu$m, the intermediate resistor itself may be broken by electric discharge. Conversely, if the thickness is more than 3000 $\mu$m, the intermediate resistor works as an insulator too strongly. Accordingly, electric discharge may not be generated unless a high voltage is applied to the charging member 13.

Further, the material of the intermediate resistor can be selected as necessary. The resistance layer 16 of each of the charging members shown in FIG. 3, FIG. 6, FIG. 7, FIG. 10, and FIG. 11 can be made of any resin such as polyolefin resin, polyester resin, nylon resin, polyurethane resin, or polycarbonate resin. Conductive filler (e.g., powder of conductive carbon, titanium oxide, tin oxide, zinc oxide, graphite, aluminum, or nickel) is added to any of these resins to enable control of the volume resistivity.

Since the charging member 13 shown in FIG. 11 has the form of a rectangle, a part facing the image carrier 1 has two corners 21. Therefore, electric discharge concentrates on the corners 21, which may cause uniform chargeability to the image carrier 1 to lower. While each of the charging members 13 shown in FIG. 1 to FIG. 7 is cylindrically formed, which can prevent occurrence of electric discharge from concentration on any part of the member.

The charging member 13 shown in FIG. 9 is also cylindrically formed. That is, all the charging members shown in FIG. 1 to FIG. 7 and FIG. 9 are formed cylindrically. Such cylindrical charging members can be stopped like the charging members shown in FIG. 8, FIG. 10, and FIG. 11. However, if the charging member is left stopped, electric discharge at a particular part of the charging member is promoted, and this part is getting degraded, so that the life of the member may be decreased.

To solve the problem, it is prefer to structure each of the cylindrical charging members 13 shown in FIG. 1 to FIG. 7 and FIG. 9 as a charge roller that rotates around its central axis. Based on this structure, generation of electric discharge at only a particular part of the charging member 13 is eliminated, and the life of the charging member 13 can be prolonged. Such a charge roller can be rotated in synchronism with rotation of the image carrier, or the charge roller can be driven so as to rotate in a required direction by the drive unit not shown.

It will be revealed below that charge uniformity on the surface of the image carrier can be enhanced by setting the frequency f(Hz) so as to satisfy $f(Hz) \geqq 40(1/mm) \cdot v(mm/sec)$ through experiments carried out by the inventors.

Experiment 1

In this experiment, three charging members as follows were used as rollers to be evaluated.

(1) The charge roller made of stainless steel as a whole. This charge roller corresponds to the charging members shown in FIG. 1 and FIG. 2, and is called a SUS roller as required.

(2) The charge roller made of a rigid body with a resistance layer having a volume resistivity of $10^6$ ohm-cm and a thickness of 100 $\mu$m laminated around the peripheral surface of the SUS roller. This charge roller corresponds to the charging member shown in FIG. 3, and is called a hard roller as required.

(3) The charge roller with a rubber-made elastic layer having a volume resistivity of $10^6$ ohm-cm laminated around the peripheral surface of the metal base substance (core metal), and further with a protective layer laminated around the peripheral surface of the elastic layer. This charge roller corresponds to the charging member shown in FIG. 5. Such a charge roller has been conventionally known, therefore, this charge roller is called a conventional type of roller as required.

Figure 12:
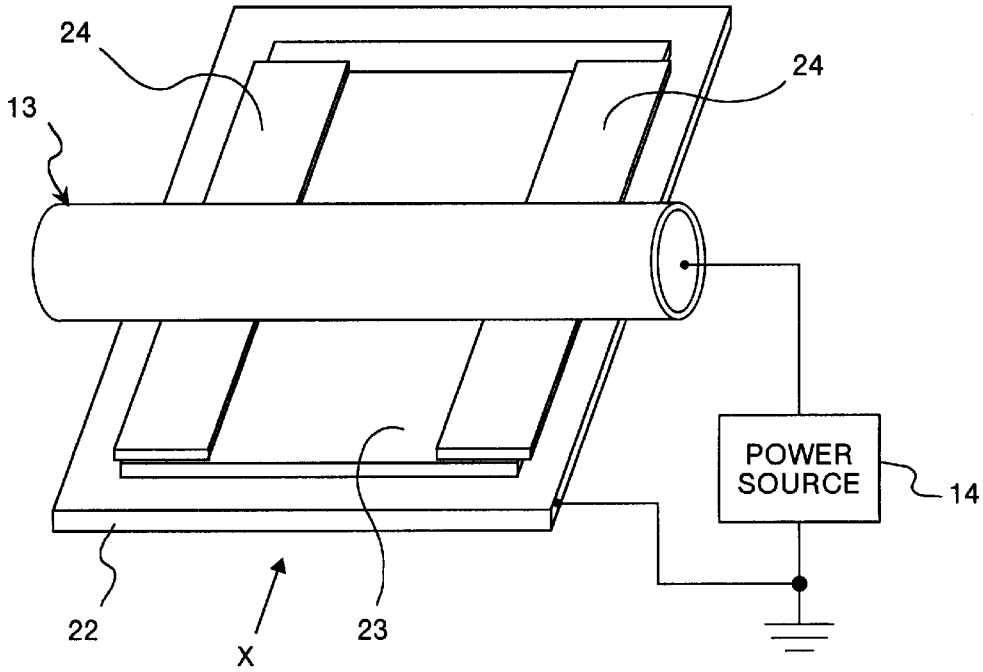
FIG. 12 is a schematic perspective view of an experimental apparatus.

FIG. 12 schematically shows an experimental apparatus. In this figure, legend 13 is assigned to each of the three rollers to be evaluated. This experimental apparatus was structured as follows. A biaxially oriented film 23 of polyethylene terephthalate (PET resin) was placed on a stage 22 movable in the direction of the arrow X, and tapes 24 of Teflon (trademark) were adhered to both sides of the film. Any of the three rollers 13 to be evaluated, that is, the SUS roller, the hard roller, and the conventional type of roller was rotatably placed on both of the tapes 24 although its position was fixed. The stage 22 was moved in the direction of the arrow X while applying a voltage to each of the charge rollers by the power source 14, and the film 23 was charged. The film 23 was regarded as an image carrier, and the charged film 23 was developed by toner. How charge unevenness occurred was observed from density unevenness of the toner image. The thickness of the film 23 was 25 $\mu$m, dielectric constant of the film was 3, and a gap between the film and the roller to be evaluated was 100 $\mu$m.

In order to evaluate a relation between occurrence of charge unevenness and a speed of the film 23, the movement rate of the stage 22 was changed to a rate between 50 and 200 mm/sec. The voltage applied to the roller to be evaluated was a voltage obtained by superposing an AC voltage of 2 to 10 KHZ on a DC voltage of −0.8 KV. The peak-to-peak voltage Vpp of the AC voltage was 3 KV.

Figure 13:
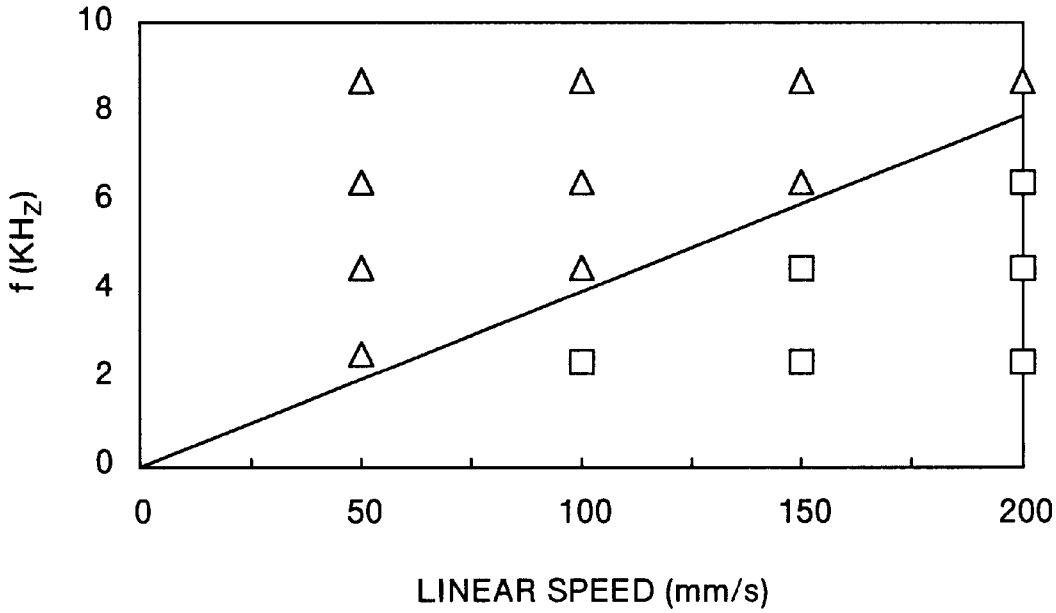
FIG. 13 is a diagram showing experimental results.

Regarding the relation between the speed (mm/sec) of the film 23, the frequency f(Hz) of the AC voltage, and the occurrence of charge unevenness, the results as shown in FIG. 13 were obtained through the experiments. A triangle as one symbol in FIG. 13 indicates that there was no charge unevenness, and a square as the other symbol indicates that the charge unevenness occurred.

It is understood from FIG. 13 that the charge unevenness was hard to occur when the frequency was high, no matter how fast the movement rate of the film 23 may be. It is also understood that the frequency at which the charge unevenness could be eliminated became high as the movement rate of the film 23 was increased. Further, even if any of the rollers to be evaluated was used, the charge unevenness could be eliminated on condition that the relation of $f(Hz) \geqq 40(1/mm) \cdot v(mm/sec)$ was satisfied. That is, in order to uniformly charge the film 23, a voltage obtained by superposing an AC voltage of a frequency f(Hz) having a value, which is 40 times or more the movement rate v (mm/sec) of the film, on a DC voltage is applied to each of the charge rollers such as the SUS roller, the hard roller, and the conventional type of roller. By doing this, charge unevenness can be eliminated.

The experiments were carried out under the same conditions as explained above except that only a DC voltage was applied to each of the charge rollers. As a result, it was recognized that linear-shaped charge unevenness occurred on the toner image of the developed film.

It is not perfectly clear why occurrence of charge unevenness can be eliminated by satisfying the condition of $f(Hz) \geqq 40\ (1/mm) \cdot v(mm/sec)$. However, assumption will be made as follows.

While a voltage satisfying the condition, under which the charged body can be uniformly charged, is applied to each of the charge rollers to charge the surface of the charged body, pale light emission can be observed even by the naked eye in the region of electric discharge between the charge roller and the surface of the charged body. This means that ions can actively be generated in the region of electric discharge. When this region becomes such an ion-rich state, a large amount of ions existing in space is adhered to the surface of the charged body so as to cover the surface. It is thought that such a surface produces a uniformly charged state in which the charge is converged on the voltage of the DC voltage component. By setting the frequency of the AC voltage to be applied to a high value, a large amount of ions are produced, the ions are uniformly adhered to the charged body, so that the surface of the charged body can uniformly be charged. Further, by setting the peak-to-peak voltage Vpp of the AC voltage to a value which is twice or more the charge start voltage, reverse discharge is sufficiently generated at the gap between the charge roller and the charged body. It is also thought that the effect due to uniform charge is enhanced by the action of the reverse discharge.

A large amount of ions is required to uniformly charge the surface of the charged body as the movement rate of the charged body increases. Therefore, the frequency f(Hz) of the AC voltage to be applied is increased as the movement rate of the surface of the charged body becomes faster, so that the amount of ions to be generated is increased. Thereby, it is also possible to evenly charge the surface of the charged body that moves at a high speed.

Experiment 2

The experiment to charge the film 23 was carried out by using the apparatus used in EXPERIMENT 1, the SUS roller, and the hard roller. At this time, a film with a pinhole previously made was used as the film 23. As a result, when the SUS roller was used, abnormal discharge occurred at the pinhole part. In contrast, when the hard roller was used, the film 23 including the pinhole part could be uniformly charged. This is thought to be an effect due to the resistance layer of the hard roller.

Experiment 3

The experiment was carried out by bringing the hard roller into contact with the film 23 by using an experimental apparatus obtained by peeling the tapes 24 off the apparatus used in EXPERIMENT1. As a result of developing the charged film, density unevenness was observed on the toner image. Therefore, the surface potential on the film 23 after being charged was measured. As a result, dispersion in the charged potential was recognized. This is because the hard roller having a high surface potential slightly jumped due to vibrations caused by movement of the stage 22 so that the hard roller could not tightly contact the surface of the film 23. Accordingly, it can be understood that using the non-contact method is preferable when the charging member having a high degree of hardness with no elastic layer is used. The non-contact method is a method for disposing the charging member spaced by a fine gap from the charged body.

The specific example of the case where the charged body is formed with the image carrier having a toner image formed on its surface has been explained. However, each of the structures may be applicable to another charging device such as any device requiring uniform charging and discharging like a discharging device for an IC substrate.

According to one aspect of this invention, charge uniformity on the charged body can be increased with a simple structure.

Further, the above-mentioned effect can more surely be achieved.

Further, the charging member is not in contact with the charged body, thus preventing degradation and dirt of the charged body.

Further, it is possible to further uniformly charge the surface of the charged body by increasing straightness of the charging member.

Further, the charging member can be brought into tight contact with the surface of the charged body, thus increasing charge uniformity on the charged body.

Further, even if a pinhole exists on the charged body, current concentration can be prevented in the intermediate resistor, thus preventing occurrence of abnormal discharge.

Further, occurrence of electric discharge concentrating on a particular part of the charging member can be prevented, thus more securely performing uniform charge.

Further, it is possible to prevent only a particular part of the charging member from its becoming the surface of electric discharge. Resultantly, degradation in the charging member due to electric discharge can be suppressed, thus prolonging the life of the charging member.

According to another aspect of this invention, the image formation apparatus having the above effect can be provided.

The present document incorporates by reference the entire contents of Japanese priority documents, 2000-159465 filed in Japan on May 30, 2000 and 2001-136653 filed in Japan on May 7, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A charging device which has a charging member provided opposite to the surface of a movable charged body, and charges said charged body by applying a voltage obtained by superposing an AC voltage on a DC voltage to said charging member and the surface of said charged body, the charging member positioned in a non-contact state with respect to the surface of the charged body while charging the charged body, wherein a frequency f(Hz) is set so as to satisfy $f(Hz) \geqq 40(1/mm) \cdot v(mm/sec)$ where the frequency of the AC voltage is f(Hz) and a movement rate of the surface of said charged body is v(mm/sec).

2. The charging device according to claim 1, wherein a peak-to-peak voltage of an AC voltage to be applied to said charging member is set to a voltage which is twice or more a charge start voltage on said charged body.

3. The charging device according to claim 1, wherein said charging member is formed with a material having JIS A hardness of 90 degrees or more.

4. The charging device according to claim 3, wherein said charging member is made of metal.

5. The charging device according to claim 1, wherein said charging member comprises:

a base substance to which the voltage is applied; and an intermediate resistor which is provided on the side of said base substance facing the surface of said charged body, and has a volume resistivity higher than that of said base substance.

6. The charging device according to claim 1, wherein said charging member is cylindrically formed.

7. The charging device according to claim 6, wherein said charging member is formed as a charge roller that rotates.

8. An image forming apparatus having a charging device which has a charging member provided opposite to the surface of a movable charged body, and charges said charged body by applying a voltage obtained by superposing an AC voltage on a DC voltage to said charging member to produce electric discharge between said charging member and the surface of said charged body, the charging member positioned in a non-contact state with respect to the surface of the charged body while charging the charged body, wherein a frequency f(Hz) is set so as to satisfy $f(Hz) \geqq 40(1/mm) \cdot v(mm/sec)$ where the frequency of the AC voltage is f(Hz) and a movement rate of the surface of said charged body is v(mm/sec).

9. The image forming apparatus according to claim 8, wherein a peak-to-peak voltage of an AC voltage to be applied to said charging member is set to a voltage which is twice or more a charge start voltage on said charged body.

10. The image forming apparatus according to claim 8, wherein said charging member is formed with a material having JIS A hardness of 90 degrees or more.

11. The image forming apparatus according to claim 10, wherein said charging member is made of metal.

12. The image forming apparatus according to claim 8, wherein said charging member comprises:

a base substance to which the voltage is applied; and an intermediate resistor which is provided on the side of said base substance facing the surface of said charged body, and has a volume resistivity higher than that of said base substance.

13. The image forming apparatus according to claim 8, wherein said charging member is cylindrically formed.

14. The image forming apparatus according to claim 13, wherein said charging member is formed as a charge roller that rotates.

* * * * *